US005832935A

United States Patent [19]

Heine

[11] Patent Number: 5,832,935

[45] Date of Patent: Nov. 10, 1998

[54] TOBACCO STORAGE AND SMOKING APPARATUS

[75] Inventor: Randolph A. Heine, Pinellas Park, Fla.

[73] Assignee: New Tradition Pipe Co., Pinellas Park, Fla.

[21] Appl. No.: 999,784

[22] Filed: Feb. 18, 1997

Related U.S. Application Data

[63] Continuation of Ser. No. 528,787, Sep. 15, 1995, abandoned.

[51] Int. Cl.[6] ..... A24F 23/04

[52] U.S. Cl. ..... 131/329; 206/236; 206/244; 131/226

[58] Field of Search ..... 131/329, 330, 131/180, 216, 220, 226, 227; 206/244, 236, 242, 252, 264, 265, 267

[56] References Cited

U.S. PATENT DOCUMENTS

| | | | |
|---|---|---|---|
| 2,485,222 | 10/1949 | Vermilyea | 131/216 X |
| 4,080,972 | 3/1978 | Furlow | 131/180 |
| 4,214,658 | 7/1980 | Crow . | |
| 4,294,267 | 10/1981 | Glymph | 131/330 |
| 5,465,738 | 11/1995 | Rowland | 131/329 |

*Primary Examiner*—John G. Weiss
*Attorney, Agent, or Firm*—Larson & Larson, P.A; James E. Larson

[57] ABSTRACT

A tobacco storage and smoking apparatus includes a housing having a first chamber which receives smoking materials such as tobacco and is covered by a cover including a bowl recess with a side passageway extending from the bowl recess to one end of the cover. The housing has a second chamber on an opposite side of the housing from the first chamber removably containing a stem having a through passageway and intended to be assembled to the cover to create a smoking pipe. The second chamber is downwardly open and may be closed by a further cover. If desired, the second chamber may contain a spring recess partially receiving a coil spring which biases the stem toward a direction of removal from the second chamber.

14 Claims, 2 Drawing Sheets

TOBACCO STORAGE AND SMOKING APPARATUS

This application is a continuation of Ser. No. 08/528,787 filed on Sep. 15, 1995, now abandoned.

BACKGROUND OF THE INVENTION

The present invention relates to a tobacco storage and smoking apparatus. Applicant is aware of U.S. Pat. No. 4,214,658 to Crow disclosing a smoking system including an elongated pipe receivable in one housing chamber and a second chamber receiving smoking materials, with the pipe being inserted into the smoking material chamber to receive smoking materials therein which may subsequently be smoked. The present invention differs from the teachings of Crow as contemplating a housing having a chamber for receiving smoking materials covered by a cover including structure forming a portion of a pipe used to smoke the smoking materials. A further chamber receives a stem of the pipe which may be inserted into a cover to form the pipe.

SUMMARY OF THE INVENTION

The present invention relates to a tobacco storage and smoking apparatus. The present invention includes the following interrelated objects, aspects and features:

(A) In a first aspect, the present invention includes a housing having a first chamber and a second chamber. The first chamber is preferably larger than the second chamber and is intended to receive smoking materials such as, for example, tobacco.

(B) To either side of the opening of the first chamber, dovetail recesses are formed to receive a corresponding dovetail projection of a cover for the first chamber. The cover includes a hollowed out bowl recess as well as a side passageway extending the length of the cover and terminating in a fluid coupling.

(C) The housing includes a second chamber on an opposite side of the housing from the first chamber sized to receive an elongated stem having a tapered end with a sharpened edge. The stem is designed to be inserted into one cover in axial alignment with a passageway in the cover leading to a hollowed out bowl recess of the above-described cover. After the bowl recess has been filled by dipping tobacco, usually by fingers, from the first chamber, the tapered end of the stem can be inserted into the fluid coupling of the cover to create a smoking pipe. A match or other lighter mechanism may be employed to light the smoking materials contained within the bowl recess which smoking materials may be suitably smoked.

(D) The second chamber may include a spring recess which partially receives a spring such as, for example, a coil spring designed to bias the stem in the direction of removal from the second recess. A further cover may be slidably received in grooves formed to either side of the opening of the second recess to allow closure of the second chamber and retention, therein, of the stem. When the further cover is slidably removed from overlying relation to the second chamber, the spring causes the stem to be urged out of the second chamber.

(E) In the preferred embodiment of the present invention, the cover, housing and further cover are made of wood while the stem is made of a metallic sleeve covered with a wood veneer. In the preferred embodiment, the spring is made of metal.

Accordingly, it is a first object of the present invention to provide a tobacco storage and smoking apparatus.

It is a further object of the present invention to provide such an apparatus including a housing having one chamber for storage of smoking materials and another chamber for storage of a stem, such stem being combined with the cover for the first-mentioned chamber to create a smoking pipe.

It is a still further object of the present invention to provide such a housing, cover and further cover made of wood.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
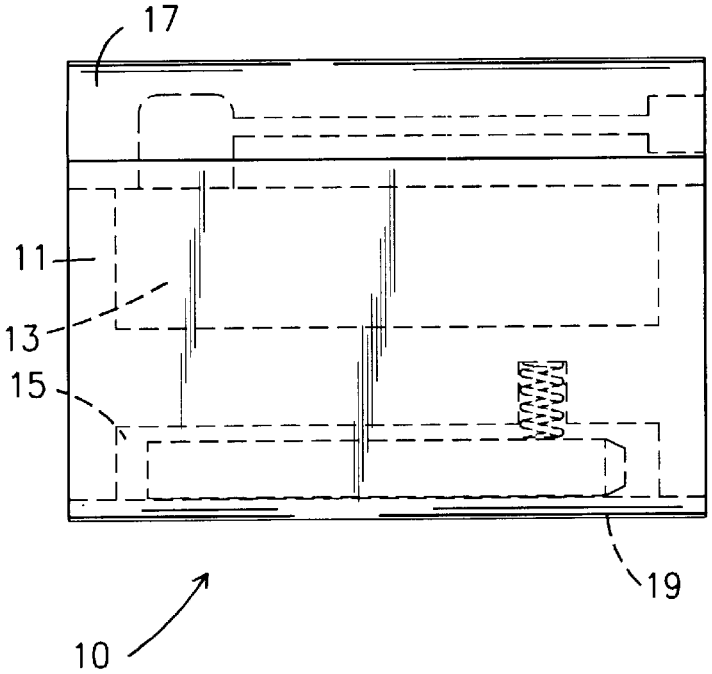
FIG. 1 shows a side view of the present invention with pertinent internal portions thereof shown in phantom.
Figure 2:
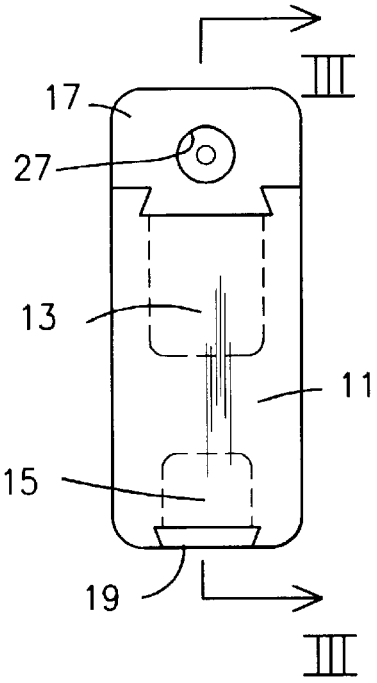
FIG. 2 shows an end view of the present invention with pertinent portions thereof shown in phantom.

With reference to the figures, the present invention is generally designated by the reference numeral 10 and is seen to include a housing 11 having a first chamber 13 and a second chamber 15. The first chamber 13 is releasably closed by the cover 17 while the second chamber 15 is releasably closed by the further cover 19.

Figure 3:
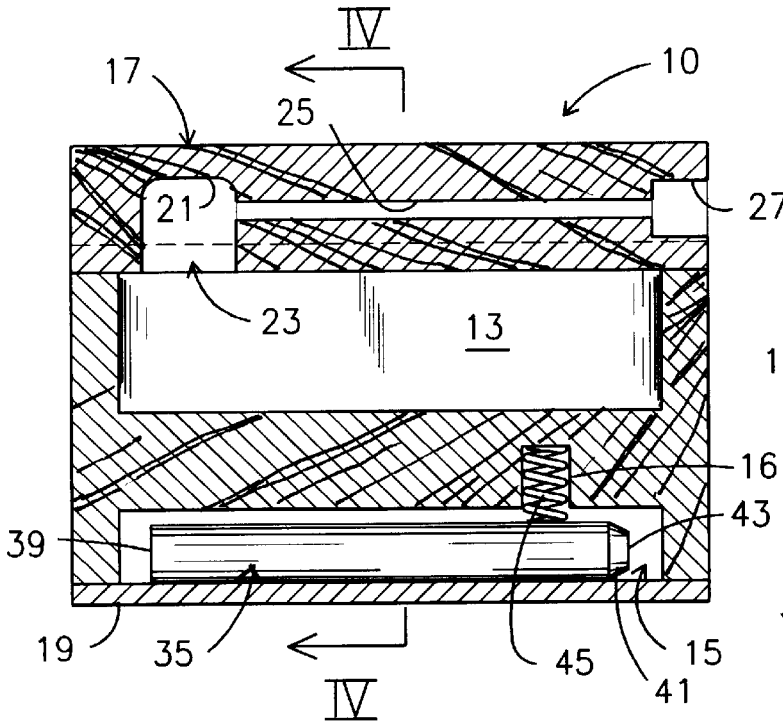
FIG. 3 shows a cross-sectional view along the line III—III of FIG. 2.
Figure 4:
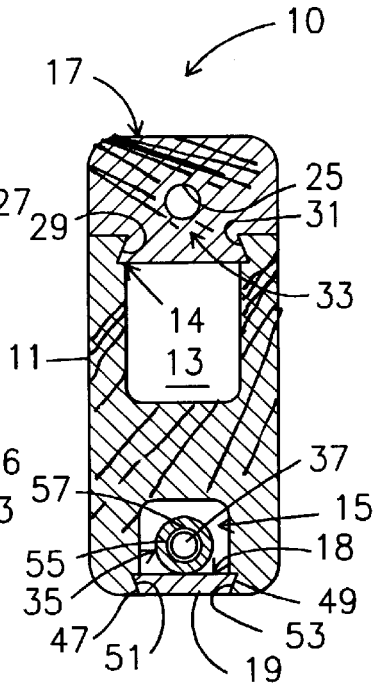
FIG. 4 shows a cross-sectional view along the line IV—IV of FIG. 3.

With particular reference to FIGS. 3 and 4, it is seen that the first cover 17 includes a bowl recess 21 having an outward opening at 23 and having a side passageway 25 fluidly connected thereto and terminating remote from the bowl recess at a fluid coupling 27, provided for a purpose to be described in greater detail hereinafter.

Figure 6:
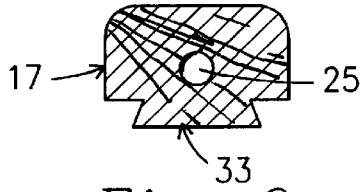
FIG. 6 shows a cross-sectional view corresponding to that of FIG. 4 but solely showing the first-mentioned cover.

As best seen in FIG. 4, the housing 11 includes an opening 14 for the chamber 13 which is defined by dovetail grooves 29 and 31 which are intended to receive the side edges of the dovetail projection 33 of the cover 17. As best understood from comparison of FIGS. 3, 6 and 7, the cover 17 is slidably disposed over the recess 13 by virtue of the interaction of the dovetail projection 33 of the cover 17 in combination with the dovetail recesses 29 and 31 on the housing 11. Thus, the cover 17 may be slidably removed from overlying relation to the chamber 13 by virtue of this interaction.

With reference to FIGS. 3 and 4, in particular, the chamber 15 is sized to receive an elongated stem 35 having a passageway 37 extending completely therethrough and including a first end 39 having a generally flat configuration and a second tapered end 41 which tapers to a sharpened edge 43.

With particular reference to FIG. 3, it is seen that the chamber 15 may include a sub-chamber 16 sized to receive a spring 45 such as the coil spring shown which is partially received within the sub-chamber 16 and extends therefrom to bias the stem 35 in the downward direction in the view of FIG. 3, a direction toward removal from the chamber 15.

Figure 5:
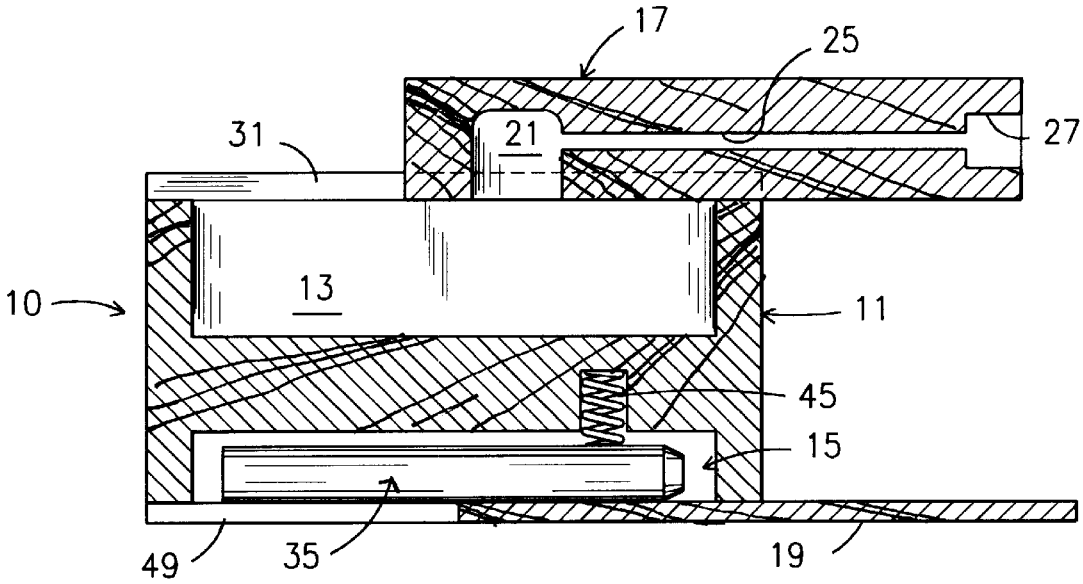
FIG. 5 shows a cross-sectional view similar to that of FIG. 3 but showing the cover and further cover partially removed from the housing.

With particular reference to FIGS. 4 and 5, the further cover 19 includes tapered edges 47 and 49 slidably received within the respective tapered edges 51 and 53 and formed to either side of the opening 18 (FIG. 4) of the chamber 15. As shown in FIG. 5, the further cover 19 may be slid with respect to the housing 11 to expose the stem 35 to view whereupon the spring 45 acts to bias the stem 35 in a direction of easy removal from the second chamber 15.

Figure 8:
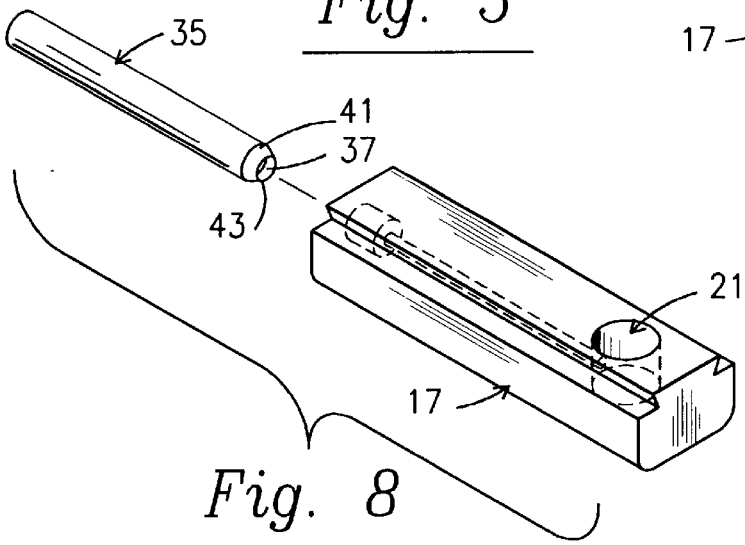
FIG. 8 shows an exploded perspective view of the cover prior to assembly as a smoking pipe.
Figure 7:
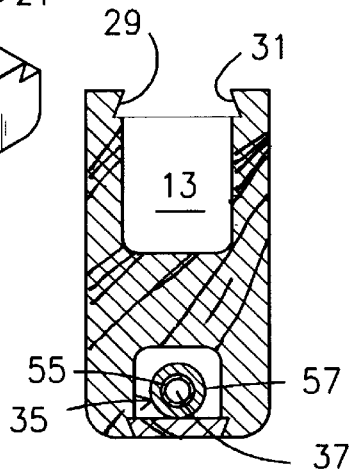
FIG. 7 shows a cross-sectional view similar to that of FIG. 4 but omitting the first-mentioned cover.
Figure 9:
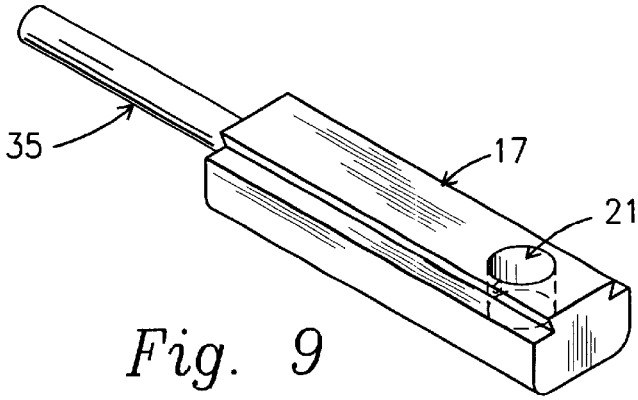
FIG. 9 shows a perspective view showing the cover assembled as a smoking pipe.

As best seen in FIGS. 4 and 7, in the preferred embodiment of the stem 35, the stem is made of an inner, preferably metallic, sleeve 55 covered with a wood veneer covering 57. The passageway 37 extends through the metal sleeve 55. FIG. 8 shows the stem 35 and the cover 17 in axially aligned adjacency with the bowl recess 21 clearly visible. FIG. 9 shows the stem 35 coupled to the cover 17 to comprise a smoking pipe.

With the above description in mind, the operation of the inventive apparatus should be self-evident.

With the apparatus in the configuration shown in FIG. 3, in particular, with smoking materials filling the first chamber 13 and with the stem 35 contained within the second chamber 15, the further cover 19 is slid to one side, as best seen with reference to FIG. 5, until the second chamber 15 is completely exposed whereupon the stem 35 may be removed either through the force of gravity when the inventive apparatus 10 is in the orientation shown in FIGS. 1–5, or in any orientation by virtue of the operation of the spring 45 acting to expel the stem 35 from the chamber 15. Once the stem 35 has been removed from the second chamber 15, the further cover 19 may be suitably restored to its position as best seen in FIG. 3.

Thereafter, the cover 17 may be slidably removed from the housing 11, as best explained from a comparison of FIGS. 3 and 5, to expose the first chamber 13. Tobacco is removed from chamber 13 to fill the bowl recess 21 of the cover 17. After the bowl recess 21 is filled with smoking materials, the end 41 of the stem 35 is inserted into the fluid coupling 27 of the cover 17, as best explained with reference to FIGS. 8 and 9, so that the stem 35 and the cover 17 combine together to form a smoking pipe, best seen in FIG. 9. Ignition means such as, for example, a match or lighter mechanism, may be employed to light smoking materials contained within the bowl recess 21 and the end 39 of the stem 35 may be placed in the mouth of the user so that the smoking materials contained within the bowl recess 21 may be "smoked".

In the preferred embodiment of the present invention, the housing 11, cover 17 and further cover 19 are suitably made of any desired species of wood. The stem 35, in the preferred embodiment of the present invention, may be made of an inner metallic sleeve 55 covered with a wood veneer covering 57, again, made of any suitable species of wood.

In the preferred embodiment of the present invention, the spring 45 comprises a metallic coil spring.

As such, an invention has been disclosed in terms of a preferred embodiment thereof which fulfills each and every one of the objects of the invention as set forth hereinabove and provides a new and useful tobacco storage and smoking apparatus of great novelty and utility.

Of course, various changes, modifications and alterations in the teachings of the present invention may be contemplated by those skilled in the art such as inverting the positions of covers 17 and 19 without departing from the intended spirit and scope thereof.

As such, it is intended that the present invention only be limited by the terms of the appended claims.

I claim:

1. A smoking material storage and smoking apparatus, comprising:

a) a housing having a first chamber adapted to receive smoking material therein, said first chamber having a first longitudinal opening;

b) a first cover movable from a first position covering said first longitudinal opening to a second position exposing said first chamber;

c) said first cover including a passageway extending longitudinally therethrough and having an opening at a first and second end, said passageway at least partially fillable with smoking material whereby said first cover may be employed as a smoking apparatus;

d) the housing having a second chamber containing a stem therein the stem being removable and attachable to the first end of the passageway in the first cover, said second chamber having a second longitudinal opening; and e) a second cover moveable from a first position covering said second longitudinal opening to a second position exposing said second chamber.

2. The apparatus of claim 1, wherein said passageway includes a bowl recess at the second end adapted to receive smoking material therein.

3. The apparatus of claim 1, wherein said first cover is slidably received on said housing.

4. The apparatus of claim 3, wherein said housing has dovetail grooves and said first cover has a dovetail projection engageable with said grooves.

5. The apparatus of claim 1, further including a spring disposed in said second chamber and urging said stem in a direction out of said second chamber.

6. The apparatus of claim 5, wherein said spring is partially disposed within a recess connected to said second chamber.

7. The apparatus of claim 1, wherein said stem has a further passageway therethrough.

8. The apparatus of claim 7, wherein said stem attachable to said first cover at the first end of the passageway in the first cover has the further passageway fluidly coupled to said passageway in the first cover to form a smoking pipe.

9. A smoking material storage and smoking apparatus, comprising:

a) a housing having a first rectangular chamber adapted to receive smoking material therein, said first chamber having an opening;

b) a cover movable from a first position covering said opening to a second position exposing said first chamber;

c) said cover including a longitudinal passageway extending therethrough and at least partially fillable with smoking material whereby said cover may be employed as a smoking apparatus;

d) said passageway including a bowl recess at one end adapted to receive smoking material therein;

e) said cover being slidably received on said housing;

f) said housing including a second rectangular chamber parallel to said first chamber and a stem having a further passageway therethrough, the stem being removably received within said second rectangular chamber;

g) said stem being attachable to said cover with said further passageway fluidly coupled to said longitudinal passageway to form a smoking pipe.

10. The apparatus of claim 9, further including a further cover removably covering an opening exposing said second rectangular chamber.

11. The apparatus of claim 10, further including a spring disposed in said second rectangular chamber and urging said stem in a direction out of said second rectangular chamber.

12. The apparatus of claim 11, wherein said spring is partially disposed within a recess connected to said second chamber.

13. A smoking material storage and smoking apparatus, comprising:

a) a housing having a first and a second longitudinal chamber on opposed sides, each chamber having an opening exposing the chamber, b) a first cover enclosing one of the longitudinal chambers, the first cover containing a first longitudinal passageway through a central portion of the first cover from an open end to a closed end, a portion of the cover juxtaposed to the closed end on a surface facing the longitudinal chamber having a bowl in fluid contact with the longitudinal passageway;

c) one of the longitudinal chambers containing a stem having a further passageway therethrough, the stem removably received within the longitudinal chamber;

d) the stem adapted to be attached to the open end of the first cover so that it is in fluid contact with the first longitudinal passageway through the first cover; and e) a second cover adapted to cover the opening to the other chamber.

14. A smoking material storage and smoking apparatus according to claim 13 wherein the first and second covers respectively slidably cover the openings exposing the first and second longitudinal chambers.

* * * * *